US005155695A

United States Patent [19]

Stein

[11] Patent Number: 5,155,695

[45] Date of Patent: Oct. 13, 1992

[54] TIME SCALE COMPUTATION SYSTEM INCLUDING COMPLETE AND WEIGHTED ENSEMBLE DEFINITION

[75] Inventor: Samuel R. Stein, Boulder, Colo.

[73] Assignee: Timing Solutions Corporation, Boulder, Colo.

[21] Appl. No.: 538,898

[22] Filed: Jun. 15, 1990

[51] Int. Cl.[5] ..... G04C 11/00

[52] U.S. Cl. ..... 364/569; 368/46; 368/184

[58] Field of Search ..... 364/569; 368/184, 202, 368/46, 47, 56

[56] References Cited

U.S. PATENT DOCUMENTS 4,809,005 2/1989 Counselman, III ..... 342/352
4,899,117 2/1990 Vigi ..... 331/3

OTHER PUBLICATIONS

Richard H. Jones and Peter V. Tryon, "Estimating Time from Atomic Clocks", Journal of Research of the National Bureau of Standards, vol. 88, No. 1, pp. 17–24, Jan.–Feb. 1983.

Allan, et al., "Time and Frequency: Theory and Fundamentals", NBS Monograph 140, Chapter 9, pp. 205–231, U.S. Department of Commerce/National Bureau of Standards, 1972.

*Primary Examiner*—Dale M. Shaw
*Assistant Examiner*—S. A. Melnick
*Attorney, Agent, or Firm*—Sheridan Ross & McIntosh

[57] ABSTRACT

An improved system for providing ensemble time from an ensemble of oscillators is provided. In the system, a more complete ensemble definition permits a more accurate ensemble time to be calculated. The system takes into account at least weighted time and weighted frequency aspects or weighted time and weighted frequency aging aspects of each oscillator in the ensemble. Preferably, the system takes into account all of the weighted time aspects, weighted frequency aspect, and weighted frequency aging aspects for each oscillator in the ensemble. The weights with respect to each clock can be chosen to be either zero or any positive value such that the sum of the weights for each aspect sum to one. The system can be implemented using a Kalman approach.

25 Claims, 1 Drawing Sheet

TIME SCALE COMPUTATION SYSTEM INCLUDING COMPLETE AND WEIGHTED ENSEMBLE DEFINITION

BACKGROUND OF THE INVENTION

1. Field of the Invention

The present invention relates to the system employed and circuitry used with an ensemble of clocks to obtain an ensemble time. More particularly, the present invention relates to an improved algorithm defining ensemble time that can be, for example, implemented with Kalman filters for obtaining an improved estimate of time from an ensemble of clocks.

2. Description of the Related Art

For a number of years, groups of precision clocks used in combination have provided the "time" in situations in which high precision timekeeping is required. For example, an "official" time for the United States is provided by the atomic time scale at the National Bureau of Standards, the UTC(NBS), which depends upon an ensemble of continuously operating cesium clocks. The time interval known as the "second" has been defined in terms of the cesium atom by the General Conference of Weights and Measures to be the duration of 9,192,631,770 periods of the radiation corresponding to the transition between the two hyperfine levels of the ground state of the cesium-133 atom. Other clocks may be calibrated according to this definition. Thus, while each clock in a group or ensemble of clocks is typically some type of atomic clock, each clock need not be a cesium clock.

Even though one such atomic clock alone is theoretically quite accurate, in many applications demanding high accuracy it is preferred that an ensemble of atomic clocks be used to keep time for a number of reasons. Typically, no two identical clocks will keep precisely the identical time. This is due to a number of factors, including differing frequencies, noise, frequency aging, etc. Further, such clocks are not 100% reliable; that is, they are subject to failure. Accordingly, by using an ensemble of clocks in combination, a more precise estimate of the time can be maintained.

When an ensemble of clocks is utilized to provide an estimate of time, various techniques may be employed for processing the signals output by the clocks to obtain the "time". Typically, interclock time comparisons are made to determine the relative time and frequency of each clock. The noise spectrum of each clock is represented by a mathematical model, with noise parameters determined by the behavior of the individual clock. Clock readings are combined based on these comparisons and models to produce the time scale.

One technique for processing clock readings involves the use of Kalman filters. Kalman filters have a number of favorable characteristics that lend them to use in timekeeping. Most important of these characteristics are that Kalman filters are minimum squared error estimators and are applicable to dynamic systems. Starting with a physical model for each clock and the definition of an ensemble of clocks, Kalman filters may be used to perform the calculation of the estimated time.

Among their capabilities, Kalman filters produce estimates which are optimum in the minimum squared error sense both in steady state and transient condition. Thus, Kalman filters provide the state estimation and forecasting functions necessary for processing data from an ensemble of clocks. The use of actual system dynamics in the estimation process stabilizes the state estimates against occasional large measurement errors, as Kalman filters automatically provide estimates of the errors of each component of the state vector.

Of course, the goal in any technique used to process clock outputs is to obtain the most uniform scale of time. Generally, the performance of any such technique depends on the realism of the mathematical models used to describe the clocks of the ensemble and the definition of the time scale. In this regard, previously utilized algorithms have failed to provide a complete definition of ensemble time. That is, such definitions have accounted for time state only.

Of importance, prior designers have not fully accounted for the frequency states of member clocks with respect to the ensemble. More particularly, previous algorithms have effectively failed to fully define and employ correlations between the relative states of the clocks with respect to the ensemble. Thus, when a Kalman or any other approach using these definitions has been used, the accuracy of the resulting estimates of clock frequency and estimates of clock parameters has suffered, adversely impacting timekeeping performance.

In theory, such deficiencies decrease as the degree of clock identity in an ensemble increases and as the number of clocks in an ensemble increases. However, in practice, the clocks of an ensemble will not be identical, and a finite number of clocks must be used. Typically, each clock in an ensemble performs differently from the others, even if they are all the same type of clock. Therefore, practically speaking, an inadequacy exists in the prior approaches.

The deficiencies of prior approaches can be described with reference to signal processing in general. As with any type of signal processing, when a filter does not provide the appropriate filter characteristics, the accuracy of the results from processing will be sub-optimal. In the prior approaches, the ensemble definition was incomplete. Accordingly, the accuracy of the estimates of time resulting from use of the corresponding filters suffered.

SUMMARY OF THE INVENTION

Accordingly, an object of the present invention is to provide an improved ensemble definition for signal processing.

Another object of the present invention is to provide an ensemble definition which accounts for the frequency of member clocks in relation to the ensemble for improved accuracy.

An additional object of the present invention is to provide an ensemble definition which accounts for the frequency aging of member clocks in relation to the ensemble for improved accuracy.

Yet another object of the present invention is to include clock frequency measurements in ensemble calculations.

A further object of the present invention is to increase the accuracy of time and frequency step detection as part of an ensemble calculation.

A further object of the present invention is to provide an improved approach for defining an ensemble in which the system noise covariance matrix takes into account correlations between relative states of the clocks with respect to the ensemble.

Yet another object of the present invention is to provide an improved approach for defining an ensemble in which the system noise covariance matrix takes into account the continuous nature of clock noise.

An additional object of the present invention is to provide an improved ensemble definition that can be employed in Kalman filters utilized with an ensemble of clocks for timekeeping purposes.

To achieve the foregoing objects, and in accordance with the purpose of the invention, as broadly described herein, a system for providing an ensemble time comprises an ensemble of oscillators, each of which generates a respective frequency signal, a time measurement circuit for determining time differences between the frequency signals for predetermined pairs of the oscillators, and a processor for calculating ensemble time based on the time and frequency differences and weighted time, weighted frequency, and weighted frequency aging aspects of each of the oscillators. Preferably, the ensemble comprises N oscillators, one of the oscillators serving as a reference oscillator while the remaining N−1 oscillators providing an estimate of the time, frequency and frequency aging states of the reference oscillator with respect to the ensemble. The weighted time, $u_{je}(t+\delta)$, the weighted frequency, $y_{je}(t+\delta)$, and the weighted frequency aging, $w_{je}(t+\delta)$, aspects of the reference oscillator with respect to the ensemble comprise an ensemble definition where $$u_{je}(t+\delta) \equiv \sum_{i=1}^{N} a_i(t)[u_{ie}(t+\delta|t) + u_{ji}(t+\delta)]$$

$$y_{je}(t+\delta) \equiv \sum_{i=1}^{N} b_i(t)[y_{ie}(t+\delta|t) + y_{ji}(t+\delta)]$$

$$w_{je}(t+\delta) \equiv \sum_{i=1}^{N} c_i(t)[w_{ie}(t+\delta|t) + w_{ji}(t+\delta)]$$

The weights with respect to the time, frequency and frequency aging aspects of the ensemble definition are restricted only such that $$\sum_{i=1}^{N} a_i(t) = \sum_{i=1}^{N} b_i(t) = \sum_{i=1}^{N} c_i(t) = 1$$

The processor can have an associated memory in which the ensemble definition is stored in the form of Kalman filters. The processor processes the time and frequency differences utilizing the Kalman filters to provide the ensemble time. The system is designed so that a user can input new control parameters (including new weights) as desired.

Alternatively, the system can comprise an ensemble of oscillators, each of which provides a signal, a time measurement circuit for determining time differences between signals for predetermined pairs of the oscillators, and a processor for providing ensemble time based on the frequency differences and weighted time and weighted frequency aspects of each of the oscillators or weighted time and weighted frequency aging aspects of each of the oscillators. Such systems will still provide improved results with respect to prior approaches.

Other objects and advantages of the present invention will be set forth in part in the description and drawing figure which follow, and will further be apparent to those skilled in the art.

DETAILED DESCRIPTION OF THE INVENTION

Figure 1:
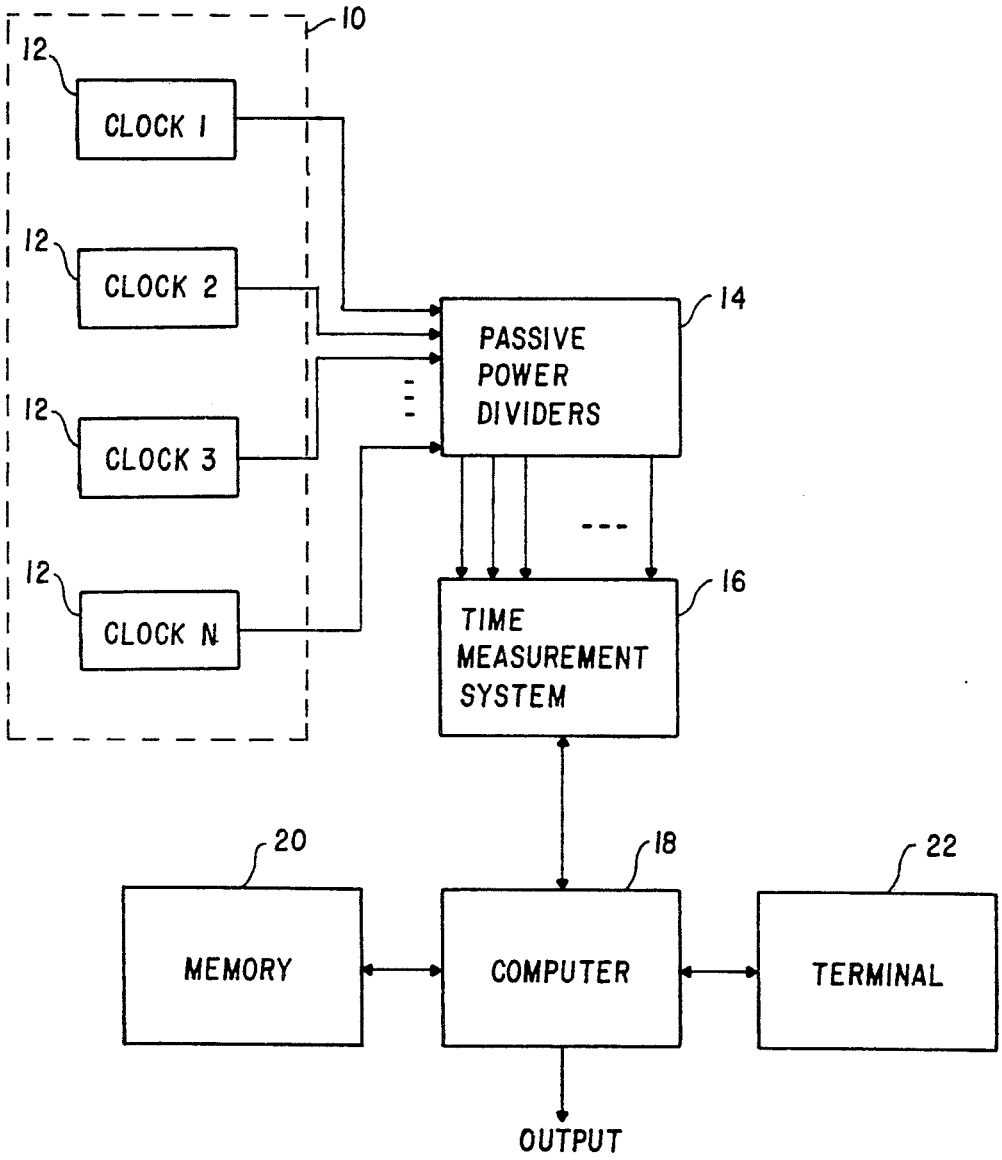
FIG. 1 is a circuit diagram of an implementation of the present invention.

As discussed previously, one method for processing the output of a plurality of clocks (i.e., oscillators) included in an ensemble is referred to as the Kalman approach. In this Kalman approach, one of the clocks in the ensemble is temporarily designated as the reference clock, with the remaining clocks "aiding" the time provided by the reference clock. Kalman filters provide state estimation and forecasting functions. Generally, Kalman filters are used to model the performance of quartz oscillators and atomic clocks. Kalman filters act as minimum square error state estimators and are applicable to dynamic systems, that is, systems whose state evolves in time. Kalman filters are recursive and therefore have modest data storage requirements. When employed to provide time from an ensemble of clocks, Kalman filters can, of course, only provide estimates that reflect the algorithms which they embody.

The novel clock model utilized in the present invention takes into account the time, the frequency, and the frequency aging. The general form of the clock model consists of a series of integrations. The frequency aging is the integral of white noise, and therefore exhibits a random walk. The frequency is the integral of the frequency aging and an added white noise term, allowing for the existence of random walk frequency noise. The time is the integral of the frequency and an added white noise term which produces random walk phase noise, usually called white frequency noise. An unintegrated additive white noise on the phase state produces additive white phase noise.

When two clocks are compared, the relative states are the differences between the state vectors of the individual clocks. Hereinbelow, the state vector of a clock i will be referred to as Only the differences between clocks can be measured. In terms of the state vectors, the differences between a clock j and a clock k at time t is denoted by $$\vec{x}_{jk}(t) \equiv \vec{x}_j(t) - \vec{x}_k(t)$$

The same approach will be used below to denote the time of a clock with respect to an ensemble. The ensemble is designated by the subscript e. Since ensemble time is a computed quantity, the ensemble is only realizable in terms of its difference from a physical clock.

In the present invention, the individual clock state vector is four-dimensional. In prior approaches, the comparable state vector has more typically been a two-dimensional state vector, taking into account only a phase component and a frequency component. In contrast, the present invention utilizes a system model which incorporates the time, the time without white phase noise, the frequency, and the frequency aging into a four-dimensional state vector, such that a four-dimensional state vector $\vec{x}_{jk}(t)$ is as follows:

$$x_{jk}(t) = \begin{bmatrix} u(t) \\ x(t) \\ y(t) \\ w(t) \end{bmatrix} \quad (1)$$

where u(t) is the time of the system at sample (t), x(t) is the time of the system without white phase noise at sample (t), y(t) is the frequency of the system at sample (t), and w(t) is the frequency aging of the system at sample (t). The state vector evolves from time t to time $t+\delta$ according to $$x_{jk}(t+\delta)=\Phi(\delta)x_{jk}(t)+\Gamma s_{jk}(t+\delta)|t)+\Phi(\delta)p_{jk}(t) \quad (2)$$

where $\Phi(\delta)$ is a $4\times4$ dimensional state transition matrix, $\Gamma\vec{s}_{jk}$ is the plant noise and $\Gamma\vec{s}_{jk}(t+\delta|t)$ is a four-dimensional vector containing the noise inputs to the system during the time interval from t to $t+\delta$, and $\vec{p}_{jk}(t)$ is a four-dimensional vector containing the control inputs made at time t.

The $4\times4$ dimensional state transition matrix $\Phi(\delta)$ embodies the system model described above. The state transition matrix is assumed to depend on the length of the interval, but not on the origin, such that $$\Phi(\delta) = \begin{bmatrix} 0 & 1 & \delta & \delta^2/2 \\ 0 & 1 & \delta & \delta^2/2 \\ 0 & 0 & 1 & \delta \\ 0 & 0 & 0 & 1 \end{bmatrix}. \quad (3)$$

The four-dimensional vector $\Gamma(\delta)\vec{s}_{jk}(t+\delta|t)$ contains the noise input to the system during the interval from t to $t+\delta$, where $$s_{jk}(t+\delta|t) = \begin{bmatrix} \beta'_{jk}(t+\delta) \\ \epsilon'_{jk}(t+\delta|t) \\ \eta'_{jk}(t+\delta|t) \\ \alpha'_{jk}(t+\delta|t) \end{bmatrix} \text{and} \quad (4)$$

$$\Gamma(\delta) = \begin{bmatrix} 1 & 1 & 0 & 0 \\ 0 & 1 & 0 & 0 \\ 0 & 0 & 1 & 0 \\ 0 & 0 & 0 & 1 \end{bmatrix}, \quad (5)$$

and where $\beta_{jk}(t+\delta)$ is the white time noise input between clocks j and k at time $(t+\delta)$, $\epsilon_{jk}(t+\delta|t)$ is the white frequency noise input at time $t+\delta$, $\eta_{jk}(t+\delta|t)$ is the random walk frequency noise input at time $t+\delta$, and $\alpha_{jk}(t+\delta|t)$ is the random walk frequency aging noise input at time $t+\delta$. Each element of $\vec{s}(t+\delta|t)$ is normally distributed with zero mean and is uncorrelated in time.

The four-dimensional vector $\vec{p}(t)$ contains the control input made at time t.

Equation 2 generates a random walk in the elements of the state vector.

A single observation z(t) can be described by a measurement equation. Such an equation relative to clocks j and k can take the following form:

$$z_{jk}(t)=H=(t)x_{jk}(t)+v_{jk}(t) \quad (6)$$

where H(t) is a $1\times4$ dimensional measurement matrix and v(t) is the scalar white noise. An observation made at time t is linear-related to the four elements of the state vector (Equation 1) by the $1\times4$ dimensional measurement matrix H(t) and the scalar white noise v(t).

The noise covariance matrix of the measurement noise, R(t), is defined as follows:

$$R(t)=E[v_{jk}(t)v_{jk}(t)^T] \quad (7)$$

where E[ ] is an expectation operator and $\vec{v}_{jk}(t)^T$ is the transpose of the noise vector.

Phase measurements of the clock relative to the reference are described by $$H(t)=(1\ 0\ 0\ 0) \text{ and } R=\sigma^2_{vxjk}. \quad (8)$$

where $\sigma^2_{vxjk}$ is the variance of the phase measurement process.

Similarly, the frequency measurements are described by $$H(t)=(0\ 0\ 1\ 0) \text{ and } R=\sigma^2_{vyjk}. \quad (9)$$

where $\sigma^2_{vyjk}$ is the variance of the frequency measurement process.

$Q^{jk}(t+\delta|t)$ is the covariance matrix of the system (or plant) noise generated during an interval from t to $t+\delta$, and is defined by $$Q^{jk}(t+\delta|t)=E[s_{jk}(t+\delta|t)s_{jk}(t+\delta|t)^T] \quad (10)$$

The system covariance matrix can be expressed in terms of the spectral densities of the noises such that $$Q^{jk}(t+\delta|t) = \begin{bmatrix} S^{jk}_{\beta'}(t)/f_h & 0 & 0 & 0 \\ 0 & S^{jk}_{\xi}(t)\delta + S^{jk}_{\mu}(t)\delta^3/3 + S^{jk}_{\zeta}(t)\delta^5/20 & S^{jk}_{\mu}(t)\delta^2/2 + S^{jk}_{\zeta}(t)\delta^4/8 & S^{jk}_{\zeta}(t)\delta^3/6 \\ 0 & S^{jk}_{\mu}(t)\delta^2/2 + S^{jk}_{\zeta}(t)\delta^4/8 & S^{jk}_{\mu}(t)\delta + S^{jk}_{\zeta}(t)\delta^3/3 & S^{jk}_{\zeta}(t)\delta^2/2 \\ 0 & S^{jk}_{\zeta}(t)\delta^3/6 & S^{jk}_{\zeta}(t)\delta^2/2 & S^{jk}_{\zeta}(t)\delta \end{bmatrix} \quad (11)$$

where $f_h$ is an infinitely sharp high-frequency cutoff. Without this bandwidth limitation, the variance of the white phase additive noise would be infinite. The clock pair spectral densities are the sum of the individual contributions from each of the clocks, $$S^{jk}=S^j+S^k \quad (12)$$

where $S^j$ and $S^k$ are the spectral densities of clocks j and k, respectively.

An alternative way to write the elements of the plant covariance matrix for a clock pair jk is $$E[\beta'_{jk}(t+\delta)\delta'_{jk}(t+\delta)]=S_{\beta}{}^{jk}(t)f_h \quad (13)$$

$$E[\epsilon'_{jk}(t+\delta|t)\epsilon'_{jk}(t+\delta|t)] = S_\epsilon^{jk}(t)\delta + S_\mu^{jk}(t)\delta^3/3 + S_\xi^{jk}(t)\delta^5/20 \quad (14)$$

$$E[\eta'_{jk}(t+\delta|t)\eta'_{jk}(t+\delta|t)] = S_\mu^{jk}(t)\delta + S_\xi^{jk}(t)\delta^3/3 \quad (15)$$

$$E[\alpha'_{jk}(t+\delta|t)\alpha'_{jk}(t+\delta|t)] = S_\xi^{jk}(t)\delta \quad (16)$$

$$E[\beta'_{jk}(t+\delta|t)\epsilon'_{jk}(t+\delta|t)] = 0 \quad (17)$$

$$E[\beta'_{jk}(t+\delta|t)\eta'_{jk}(t+\delta|t)] = 0 \quad (18)$$

$$E[\beta'_{jk}(t+\delta|t)\alpha'_{jk}(t+\delta|t)] = 0 \quad (19)$$

$$E[\epsilon'_{jk}(t+\delta|t)\eta'_{jk}(t+\delta|t)] = S_\mu^{jk}(t)\delta^2/2 + S_\Gamma^{jk}(t)\delta^4/8 \quad (20)$$

$$E[\epsilon'_{jk}(t+\delta|t)\alpha'_{jk}(t+\delta|t)] = S_\mu^{jk}(t)\delta^3/6 \quad (21)$$

$$E[\eta'_{jk}(t+\delta|t)\alpha'_{jk}(t+\delta|t)] = S_\mu^{jk}(t)\delta^2/2 \quad (22)$$

The spectral density of a noise process is the noise power per Hz bandwidth. The integral of the spectral density is the variance of the process. Thus, for a two-sided spectral density of the noise process a, $$\sigma_a^2 = \int_{-\infty}^{\infty} S_a(f)df.$$

It is this form of the plant covariance (i.e., Equations 13–22) which will be used to calculate the plant covariance of the reference clock versus the ensemble.

As discussed briefly above, one of the clocks in the ensemble is used as a reference and is designated as clock r. The choice of clock r as the reference clock is arbitrary and may be changed computationally. The role of the reference clock r is to provide initial estimates and to be the physical clock whose differences from the ensemble are calculated. Given that the ensemble consists of N clocks, each of the other N−1 clocks is used as an aiding source. That is, each of the remaining clocks provides an independent estimate of the states of clock r with respect to the ensemble. As indicated, these states are time, frequency, and frequency aging. The present invention defines the states of each clock with respect to the ensemble to be the weighted average of these estimates, and the present invention provides a user with full control over the weighting scheme. Given $\vec{x}(t_2|t_1)$ denotes a forecast of $\vec{x}$ at time $t_2$ based on the true state through time $t_1$, time, frequency, and frequency aging of a multiple weight ensemble can be defined as follows:

$$u_{je}(t+\delta) \equiv \sum_{i=1}^{N} a_i(t)[u_{ie}(t+\delta|t) + u_{ji}(t+\delta)] \quad (23)$$

$$y_{je}(t+\delta) \equiv \sum_{i=1}^{N} b_i(t)[y_{ie}(t+\delta|t) + y_{ji}(t+\delta)] \quad (24)$$

$$w_{je}(t+\delta) \equiv \sum_{i=1}^{N} c_i(t)[w_{ie}(t+\delta|t) + w_{ji}(t+\delta)] \quad (25)$$

Each new time of a clock j with respect to the ensemble depends only on the prior states of all the clocks with respect to the ensemble and the current clock difference states. The ensemble definition uses the forecasts of the true states from time t to t+δ, that is, $$x(t+\delta|t) = \Phi(t+\delta|t)x(t) \quad (26)$$

where $\vec{x}(t+\delta|t)$ is the forecasted state vector at time (t+δ) based on the true state through time t. No unsupported estimated quantities are involved in the definition.

Prior approaches have frequently used relations superficially similar to that found in equation 23 to define ensemble time. However, as the present inventor has found, equation 23 alone does not provide a complete definition of the ensemble time. Since the prior art does not provide a complete definition of the ensemble time, the filters employed in the prior art do not yield the best estimate of ensemble time. The present invention provides a more complete definition of ensemble time based not only on the time equation (equation 23), but also on the frequency and frequency aging relations (equations 24 and 25).

As noted above, $a_i(t)$, $b_i(t)$, and $c_i(t)$ represent weights to be chosen for each of the three relations described in equation 23 through 25 for each of the N clocks in the ensemble. The weights may be chosen in any way subject to the restrictions that all of the weights are positive or 0 and the sum of the weights is 1. That is, $$\sum_{i=1}^{N} a_i(t) = \sum_{i=1}^{N} b_i(t) = \sum_{i=1}^{N} c_i(t) = 1. \quad (27)$$

The weights may be chosen to optimize the performance (e.g., by heavily weighting a higher quality clock relative to the others) and/or to minimize the risk of disturbance due to any single clock failure.

In contrast to the known prior approaches, the present invention provides a time scale algorithm that utilizes more than one weighting factor for each clock. Accordingly, the present invention is actually able to enhance performance at both short and long times even when the ensemble members have wildly different characteristics, such as cesium standards, active hydrogen masers and mercury ion frequency standards. Through algebraic manipulations, the ensemble definition can be written in a form which is amenable to Kalman filter estimation. It can be shown that $$x_{je}(t+\delta) = \Phi(\delta)x_{je}(t) + \Gamma s_{je}(t+\delta|t) - \Phi(\delta)p_{je}(t) \quad (28)$$

where $$\beta'_{je}(t+\delta|t) \equiv \sum_{i=1}^{N} a_i(t)[\beta'_j(t+\delta|t) - \beta'_i(t+\delta|t)], \quad (29)$$

$$\epsilon'_{je}(t+\delta|t) \equiv \sum_{i=1}^{N} a_i(t)[\epsilon'_j(t+\delta|t) - \epsilon'_i(t+\delta|t)], \quad (30)$$

$$\eta'_{je}(t+\delta|t) \equiv \sum_{i=1}^{N} b_i(t)[\eta'_j(t+\delta|t) - \eta'_i(t+\delta|t)] \quad (31)$$

and $$\alpha'_{je}(t+\delta|t) \equiv \sum_{i=1}^{N} c_i(t)[\alpha'_j(t+\delta|t) - \alpha'_i(t+\delta|t)], \quad (32)$$

where Equation 29 represents the additive white phase noise, Equation 30 represents the random walk phase, Equation 31 represents the random walk frequency, and Equation 32 represents the random walk frequency aging.

This version of the ensemble definition is in the form required for the application Kalman filter techniques. As discussed above, the advantage of the Kalman approach is the inclusion of the system dynamics, which makes it possible to include a high degree of robustness and automation in the algorithm.

In order to apply Kalman filters to the problems of estimating the states of a clock obeying the state equations provided above, it is necessary to describe the observations in the form of equation 6. This is accomplished by a transformation of coordinates on the raw clock time difference measurements or clock frequency difference measurements. Since z may denote either a time or a frequency observation, a pseudomeasurement may be defined such that $$z^k_{je}(t_2) \equiv \begin{cases} z_{jk}(t_2) + u_{ke}(t_2|t_1) + P_{uke}(t_2|t_1) \\ \text{for time observations} \\ z_{jk}(t_2) + y_{ke}(t_2|t_1) + P_{yke}(t_2|t_1) \\ \text{for frequency observations.} \end{cases} \tag{33}$$

This operation translates the actual measurements by a calculable amount that depends on the past ensemble state estimates and the control inputs.

An additional requirement for the use of the usual form of Kalman filters is that the measurement noise, $v_{je}$, is uncorrelated with the plant noise, $\Gamma\vec{s}_{je}$. However, this is not true for the measurement model of equation 33. Through algebraic manipulations, it has been found that the noise perturbing the pseudomeasurements can be characterized as $$v^k_{je}(t_2) \equiv \begin{cases} v_{jk}(t_2) + [u_{ke}(t_2|t_1) + P_{uke}(t_2|t_1) - u_{ke}(t_2)] \\ \text{for time observations} \\ v_{jk}(t_2) + [y_{ke}(t_2|t_1) + P_{yke}(t_2|t_1) - y_{ke}(t_2)] \\ \text{for frequency observations.} \end{cases} \tag{34}$$

This pseudonoise depends on the true state at time $t_2$ and is therefore correlated with the plant noise which entered into the evolution of the true state from time $t_1$ to time $t_2$. The correlation of these noises is represented by a matrix C defined by $$C^k_j(t_2) \equiv E[\vec{s}_{je}(t_2|t_1)\vec{v}^k_{je}(t_2)^T]. \tag{35}$$

For the case of a single time measurement, $\vec{v}$ is a scalar and C is a $4\times 1$ matrix where, $$c_j^k(t_2) = -E\begin{bmatrix} \sum_{i=1}^{N} a_i^2(t_1)\beta'_i(t_2)\beta'_j(t_2) - a_j(t_1)\beta'_j(t_2)\beta'_j(t_2) - a_k(t_1)\beta'_k(t_2)\beta'_k(t_2) \\ \sum_{i=1}^{N} a_i^2(t_1)\epsilon'_i(t_2|t_1)\epsilon'_i(t_2|t_1) - a_j(t_1)\epsilon'_j(t_2|t_1)\epsilon'_j(t_2|t_1) - a_k(t_1)\epsilon'_k(t_2|t_1)\epsilon'_k(t_2|t_1) \\ \sum_{i=1}^{N} a_i(t_1)b_i(t_1)\epsilon'_i(t_2|t_1)\eta'_i(t_2|t_1) - a_j(t_1)\epsilon'_j(t_2|t_1)\eta'_j(t_2|t_1) - b_k(t_1)\epsilon'_k(t_2|t_1)\eta'_k(t_2|t_1) \\ \sum_{i=1}^{N} a_i(t_1)c_i(t_1)\epsilon'_i(t_2|t_1)\alpha'_i(t_2|t_1) - a_j(t_1)\epsilon'_j(t_2|t_1)\alpha'_j(t_2|t_1) - c_k(t_1)\epsilon'_k(t_2|t_1)\alpha'_k(t_2|t_1) \end{bmatrix}. \tag{36}$$

For a single frequency measurement, $$c_j^k(t_2) = -E\begin{bmatrix} 0 \\ \sum_{i=1}^{N} a_i(t_1)b_i(t_1)\epsilon'_i(t_2|t_1)\eta'_i(t_2|t_1) - a_k(t_1)\epsilon'_k(t_2|t_1)\eta'_k(t_2|t_1) - b_j(t_1)\epsilon'_j(t_2|t_1)\eta'_j(t_2|t_1) \\ \sum_{i=1}^{N} b_i^2(t_1)\eta'_i(t_2)\eta'_i(t_2) - a_j(t_1)\eta'_j(t_2)\eta'_j(t_2) - a_k(t_1)\eta'_k(t_2)\eta'_k(t_2) \\ \sum_{i=1}^{N} b_i(t_1)c_i(t_1)\eta'_i(t_2|t_1)\alpha'_i(t_2|t_1) - b_j(t_1)\eta'_j(t_2|t_1)\alpha'_j(t_2|t_1) - c_k(t_1)\eta'_k(t_2|t_1)\alpha'_k(t_2|t_1) \end{bmatrix}. \tag{37}$$

One method of resolving this difficulty is to extend the Kalman filter equations to allow correlated measurement and plant noise.

In this regard, it is possible to have a Kalman recursion with correlated measurement and plant noise. The error in the estimate of the state vector after the measurement at time t1 is $x(t_1|t_1)-\vec{x}(t_1)$ and the error covariance matrix is defined to be $$P(t_1|t_1)=E\{[x(t_1|t_1)-x(t_1)][x(t_1|t_1)-x(t_1)]^T\} \tag{38}$$

The diagonal elements of this n x n matrix are the variances of the estimates of the components of $\vec{x}(t_1)$ after the measurement at time $t_1$. The error covariance matrix just prior to the measurement at time $t_2$ is defined as $$P(t_2|t_1)=E\{[x(t_2|t_1)-x(t_2)][x(t_2|t_1)-x(t_2)]^T\}. \tag{39}$$

The error covariance matrix evolves according to the system model, such that $$P(t_2|t_1)=\Phi(\delta)P(t_1|t_1)\Phi(\delta)^T+\Gamma Q(t_2|t_1)\Gamma^T. \tag{40}$$

The new the state vector depends on the previous estimate and the current measurement, $$x(t_2|t_2)=\Phi(\delta)x(t_1|t_1)+\Phi(\delta)p(t_1)+K(t_2)[z(t_2)-H(t_2)\Phi(\delta)x(t_1|t_1)-H(t_2)\Phi(\delta)p(t_1)] \tag{41}$$

where the gain matrix, $K(t_2)$, determines how heavily the new measurements are weighted. The desired or Kalman gain, $K_{opt}$, is determined by minimizing the square of the length of the error vector, that is, the sum of the diagonal elements (i.e., the trace) of the error covariance matrix, such that $$K_{opt}(t_2)=P(t_2|t_1)H(t_2)^T\times[H(t_2)P(t_2|t)H(t_2)^T+R(t_2)+$$

$$H(t_2)C(t_2)+C(t_2)^T H(t_2)^T]^{-1}. \quad (42)$$

Finally, the updated error covariance matrix is given by $$P(t_2|t_2) = [I - K(t_2)H(t_2)]P(t_2|t_1)[I - K(t_2)H(t_2)]^T + K(t_2)R(t_2)K(t_2)^T - [I - K(t_2)H(t_2)]C(t_2)K(t_2)^T - K(t_2)C^T(t_2)[I - K(t_2)H(t_2)]^T \quad (43)$$

where I is the identity matrix.

Equations 40–43 define the Kalman filter. As defined, the Kalman filter is an optimal estimator in the minimum squared error sense. Each application of the Kalman recursion yields an estimate of the state of the system, which is a function of the elapsed time since the last filter update. Updates may occur at any time. In the absence of observations, the updates are called forecasts. The interval between updates, $\delta = t_2 - t_1$, is arbitrary and is specifically not assumed to be constant. It is possible to process simultaneous measurements either all at once or sequentially. In the present invention, simultaneous measurements are processed sequentially. When processing measurements sequentially, the matrix appearing in square brackets in equation (42) has dimensions of $1 \times 1$ and the matrix inversion reduces to the simple process of scalar inversion. Sequential processing is also compatible with outlier rejection.

As will be appreciated by those skilled in the art, implementation of the relationships defined in equations 40–43 as a Kalman filter is a matter of carrying out known techniques.

For the estimation of the reference clock versus the ensemble, the first step is the selection of a reference clock for this purpose. The reference clock referred to herein is distinguished from a hardware reference clock, which is normally used as the initial calculation reference. However, this "software" reference clock normally changes each time the ensemble is calculated for accuracy.

As discussed above, the ensemble consists of N clocks and therefore N estimates of the ensemble time exist. Thus, the first estimate of the ensemble time cannot be rejected and must be robust. To obtain this robust initial estimate, the median of the pseudomeasurements is computed. The clock which yields the median pseudomeasurement is selected as the calculation reference clock, and is designated clock r. In this regard $$z^r_{je} = \text{median } \{z^r_{je}\}_{k=1}^{N} \quad (44)$$

Of the N pseudomeasurements, one pseudomeasurement is a forecast and the remainder of the pseudomeasurements add new information. New pseudomeasurements must be calculated if the reference for the calculation has changed. To change reference clocks from one clock to another, i.e., from clock j to clock r, it is necessary only to form the difference, such that $$z^k_{re} = z^k_{je} - z_{jr} \quad (45)$$

This procedure works even if the initial reference clock (clock r) has been corrupted by some large error.

Once a reference clock has been identified, the plant covariance matrix may be calculated. There are ten independent elements, seven of which are nonzero. These ten elements, which correspond with Equations 13–22, are as follows:

$$E[\beta'_{re}\beta'_{re}] = (1 - a_r)^2 E[\beta'_r\beta'_r] + \sum_{i \neq r} a_i^2 E[\beta'_i\beta'_i] \quad (46)$$

$$E[\epsilon'_{re}\epsilon'_{re}] = (1 - a_r)^2 E[\epsilon'_r\epsilon'_r] + \sum_{i \neq r} a_i^2 E[\epsilon'_i\epsilon'_i] \quad (47)$$

$$E[\eta'_{re}\eta'_{re}] = (1 - b_r)^2 E[\eta'_r\eta'_r] + \sum_{i \neq r} b_i^2 E[\eta'_i\eta'_i] \quad (48)$$

$$E[\alpha'_{re}\alpha'_{re}] = (1 - c_r)^2 E[\alpha'_r\alpha'_r] + \sum_{i \neq r} c_i^2 E[\alpha'_i\alpha'_i] \quad (49)$$

$$E[\beta'_{re}\epsilon'_{re}] = 0 \quad (50)$$

$$E[\beta'_{re}\eta'_{re}] = 0 \quad (51)$$

$$E[\beta'_{re}\alpha'_{re}] = 0 \quad (52)$$

$$E[\epsilon'_{re}\eta'_{re}] = (1 - a_r - b_r)E[\epsilon'_r\eta'_r] + \sum_{i=1}^{N} a_i b_i E[\epsilon'_i\eta'_i] \quad (53)$$

$$E[\epsilon'_{re}\alpha'_{re}] = (1 - a_r - c_r)E[\epsilon'_r\alpha'_r] + \sum_{i=1}^{N} a_i c_i E[\epsilon'_i\alpha'_i] \quad (54)$$

$$E[\eta'_{re}\alpha'_{re}] = (1 - b_r - c_r)E[\eta'_r\alpha'_r] + \sum_{i=1}^{N} b_i c_i E[\eta'_i\alpha'_i] \quad (55)$$

The initial state estimate at time $t_2$ is a forecast via the reference clock r. The initial covariance matrix is the covariance before measurement. The data from all the remaining clocks are used to provide $N-1$ updates. The pseudomeasurements are processed in order of increasing difference from the current estimate of the time of the reference clock r with respect to the ensemble. Pseudomeasurement I(k) is the "k"th pseudomeasurement processed and I(1) is the reference clock forecast. Outliers (i.e., data outside an anticipated data range) are "de-weighted" when processing pseudomeasurments 2 through N using the statistic $$q_k^2 = \frac{\nu^k_{re}(t_2)\nu^k_{re}(t_2)^T}{E[\nu^k_{re}(\nu_{re})^T]}$$

where the $\nu^k_{re}(t_2)$ is the innovation or difference between the pseudomeasurment and the forecast, such that $$\nu^k_{re}(t_2) = z^k_{re}(t_2) - H(t_2)\Phi(t_2|t_1)[x(t_1|t_1) + p(t_1)]. \quad (56)$$

This equation can be rearranged in the form $$\nu_{re}(t_2) = \nu(t_2) - H(t_2)[x(t_2|t_1) - x(t_2)] \quad (57)$$

After squaring and taking the expectation value, the resu.lt is $$E[\nu^k_{re}(\nu^k_{re})^T] = H(t_2)P(t_2|t_1)H(t_2)^T + R(t_2) + 2H(t_2)\cdot \Gamma C_r^k(t_2) \quad (58)$$

To preserve the robustness of the state estimation process, deweighting of the outlier data is used rather than rejection. This preserves the continuity of the state estimates. A nonoptimum Kalman gain is calculated from $$K' = \frac{\psi_{HA}(q)}{q} K_{opt} \tag{59}$$

where $$\psi_{HA}(q) = \begin{cases} q & \text{if } |q| \leqq a \\ \frac{a}{b-a}\left[\frac{bq}{|q|} - q\right] & \text{if } a < |q| \leqq b \\ 0 & \text{if } |q| > b \end{cases} \tag{60}$$

is the Hampel's Ψ function.

When this calculation is concluded, the estimates of the states of the reference clock r with respect to the ensemble have been provided. The corresponding estimates for the remaining clocks are obtained by their values with respect to the reference clock r. This procedure is used rather than estimating the clock parameters directly with respect to the ensemble because the innovations of this process are used in parameter estimation.

The estimates of the clocks relative to reference clock r are obtained from N−1 independent Kalman filters of the type described above. The four dimensional state vectors are for the clock states relative to the reference clock r $$x_{ri}(t) = \begin{bmatrix} u_{ri}(t) \\ x_{ri}(t) \\ y_{ri}(t) \\ w_{ri}(t) \end{bmatrix}. \tag{61}$$

Every clock pair has the same state transition matrix and Γ matrix, which are provided for above in equations 3 and 5. The system covariance matrices are $Q^{ir}(t+\delta|t)$. The white phase noise is given by the measurement model $$z_{ri} = Hx_{ri} + v_{ri} \tag{62}$$

where each measurement is described by the same 4×1 row matrix $$H_{ri} = (1\ 0\ 0\ 0) \text{ or } (0\ 0\ 1\ 0) \tag{63}$$

The updated difference dates are provided in equation 41, which is one of the equations which define the Kalman filter. No attempt is made to independently detect outliers. Instead, the deweighting factors determined in the reference clock versus ensemble calculation are applied to the Kalman gains in the clock difference filters. The state estimates for the clocks with respect to the ensemble are calculated from the previously estimated states of the reference clock r with respect to the ensemble and the clock difference states, such that $$x_{je}(t_2|t_2) = x_{re}(t_2|t_2) - x_{rj}(t_2|t_2) \tag{64}$$

This essentially completes the calculation of ensemble time. The remaining task is to update all of the parameters used in the computation. The parameter estimation problem is discussed more completely below. Briefly, the parameter estimates are obtained from prediction errors of all possible clock pairs. Accordingly, rather than computing Kalman filters for N−1 clock pairs, the calculations are performed for N(N−1)/2 pairs, ij, for i=1 to N−1 and j=i+1 to N. Certainly, in a large ensemble, this may entail significant computation. But little information is added by comparison of noisy clocks with one another. For each noise type, a list of the five clocks having the lowest noise can be formed. If the index i is restricted to this more limited range, then only 5N−15 filters are required for each parameter estimated.

The outlier detection algorithm of the ensemble calculation identifies the measurements which are unlikely to have originated from one of the processes included in the model. These measurements are candidate time steps. The immediate response to a detected outlier in the primary ensemble Kalman filter is to reduce the Kalman gain toward zero so that the measurement does not unduly influence the state estimates. However, the occurrence of $M_1$ successive outliers is interpreted to be a time step. The time state of the clock that experienced the time step is reset to agree with the last measurement and all other processing continues unmodified. If time steps continue until $M_2$ successive outliers have occurred, as might happen after an extremely large frequency step, then the clock should be reinitialized. The procedure for frequency steps should be used to reinitialize the clock.

Most frequency steps are too small to produce outliers in the primary ensemble Kalman filter. This is because the small frequency steps do not result in the accumulation of large time errors during a single sample interval. Thus, all but the largest frequency steps are detected in secondary ensemble Kalman filters that are computed solely for this purpose. A set of filters with a range of sample intervals will result in the early detection of frequency steps and also produce near optimum sensitivity for a variety of clocks and performances. Recommended sample intervals are one hours, twelve hours, one day, two days, four days, eight days and sixteen days. Since time steps have already been detected (and rejected) using the primary ensemble filter, outliers detected by the secondary filters are considered to have resulted from frequency steps.

When a frequency step is detected in one of the clocks, for example, clock k, it is desirable to reduce the time constant for learning the new frequency. Therefore, a new value is calculated for the spectral density of the random walk frequency noise. First, the estimate of $S_\mu^k$ is increased sufficiently so that the detected outlier would have been considered normal. Then, the weights of the clock k are decreased to small values or zero to protect the ensemble. The clock k is then reinitialized using a clock addition procedure.

As discussed previously, the clock weights are positive, semidefinite, and sum to one, without any other restriction. It is possible to calculate a set of weights which minimizes the total noise variance of the ensemble. First, the variance of the noise in the ensemble states is calculated. This is represented by the following equations:

$$E[\beta'_e\beta'_e] = \sum_{i=1}^{N} a_i E[\beta'_i\beta'_i] \tag{65}$$

$$E[\epsilon'_e\epsilon'_e] = \sum_{i=1}^{N} a_i^2 E[\epsilon'_i\epsilon'_i] \tag{66}$$

-continued $$E[\eta'_e\eta'_e] = \sum_{i=1}^{N} b_i^2 E[\eta'_i\eta'_i] \tag{67}$$

$$E[\alpha'_e\alpha'_e] = \sum_{i=1}^{N} c_i^2 E[\alpha'_i\alpha'_i]. \tag{68}$$

The weights which minimize the noise on the states $u_e$, $y_e$, and $w_e$ are obtained by minimizing the appropriate diagonal elements of $\Gamma\bar{s}_e\bar{s}_e^T\Gamma^T$, such that $$a_k = \frac{E[\beta'_e\beta'_e] + E[\epsilon'_e\epsilon'_e]}{E[\beta'_k\beta'_k] + E[\epsilon'_k\epsilon'_k]} = \tag{69}$$

$$\frac{1}{E[\beta'_k\beta'_k] + E[\epsilon'_k\epsilon'_k]}\left[\sum_{i=1}^{N}\frac{1}{E[\beta'_i\beta'_i] + E[\epsilon'_i\epsilon'_i]}\right]^{-1}$$

$$b_k = \frac{E[\eta'_e\eta'_e]}{E[\eta'_k\eta'_k]} = \frac{1}{E[\eta'_k\eta'_k]}\left[\sum_{i=1}^{N}\frac{1}{E[\eta'_i\eta'_i]}\right]^{-1} \tag{70}$$

$$c_k = \frac{E[\alpha'_e\alpha'_e]}{E[\alpha'_k\alpha'_k]} = \frac{1}{E[\alpha'_k\alpha'_k]}\left[\sum_{i=1}^{N}\frac{1}{E[\alpha'_i\alpha'_i]}\right]^{-1}. \tag{71}$$

Alternatively, the weights can be chosen to have equal weighting for each member of the ensemble. In this case, $a_k = b_k = c_k = 1/N$.

Whatever the method used, the clock weights are chosen in advance of the calculation. However, if there is one or more outliers, the selected weights are modified by the outlier rejection process. The actual weights used can be calculated from $$a_{I(j)} = K'_{I(j)} \prod_{i=j+1}^{N} (1 - K'_{I(i)}) \tag{72}$$

where $K'_{I(1)}$ is defined as 1 and the indexing scheme is as previously described. To preserve the reliability of the ensemble, one usually limits the weights of each of the clocks to some maximum value $a_{max}$. Thus, it may be necessary to readjust the initial weight assignments to achieve the limitation or other requirements. If too few clocks are available, it may not be possible to satisfy operational requirements. Under these conditions, it may be possible to choose not to compute the ensemble time until the requirements can be met. However, if the time must be used, it is always better to compute the ensemble than to use a single member clock.

Another problem to be considered in the Kalman approach is the estimation of the parameters required by a Kalman filter. The techniques that are normally applied are Allan variance analysis and maximum likelihood analysis. However, in using the Allan variance, there is a problem in that the Allan variance is defined for equally spaced data. In an operational scenario, where there are occasional missing data, the gaps may be bridged. But when data are irregularly spaced, a more powerful approach is required.

The maximum likelihood approach determines the parameter set most likely to have resulted in the observations. Equally spaced data are not required, but the data are batch processed. Furthermore, each step of the search for the maximum requires a complete recomputation of the Kalman filter, which results in an extremely time consuming procedure. Both the memory needs and computation time are incompatible with real time or embedded applications.

A variance analysis technique compatible with irregular observations has been developed. The variance of the innovation sequence of the Kalman filter is analyzed to provide estimates of the parameters of the filter. Like the Allan variance analysis, which is performed on the unprocessed measurements, the innovation analysis requires only a limited memory of past data. However, the forecast produced by the Kalman filter allows the computation to be performed at arbitrary intervals once the algebraic form of the innovation variance has been calculated.

The innovation sequence has been used to provide real time parameter estimates for Kalman filters with equal sampling intervals. The conditions for estimating all the parameters of the filter include (1) the system must be observable, (2) the system must be invariant, (3) number of unknown parameters in Q (the system covariance) must be less than the product of the dimension of the state vector and the dimension of the measurement vector, and (4) the filter must be in steady state. This approach was developed for discrete Kalman filters with equal sampling intervals, and without modification, cannot be used for mixed mode filters because of the irregular sampling which prevents the system from ever reaching steady state. However, it is possible to proceed in a similar fashion by calculating the variance of the innovations in terms of the true values of the parameters and the approximate gain and actual covariance of the suboptimal Kalman filter that produces the innovation sequence. The innovation vector is the difference between the observation and the prediction, as follows:

$$v_{ij}(t_2) = z_{ij}(t_2) - H^{ij}(t_2)x_{ij}(t_2|t_1). \tag{73}$$

By substituting equation 73 in the measurement model (equation 6)

$$E[v(t_2)v(t_2)^T] = H(t_2)P(t_2|t_1)H(t_2)^T + R(t_2) \tag{74}$$

since the measurement noise is uncorrelated with system noise for the clock difference filters.

Adaptive modeling begins with an approximate Kalman filter gain K. As the state estimates are computed, the variance of the innovations on the left side of equation 74 is also computed. The right side of this equation is written in terms of the actual filter element values (covariance matrix elements) and the theoretical parameters. Finally, the equations are inverted to produce improved estimates for the parameters. The method of solving the parameters for discrete Kalman filters with equal sampling intervals is inappropriate here because the autocovariance function is highly correlated from one lag to the next and the efficiency of data utilization is therefore small. Instead, only the autocovariance of the innovations for zero lags, i.e., the covariance of the innovations, is used. The variances are given by $$E[v_{ij}(t+\delta)v_{ij}(t+\delta)^T] = P^{ij}_{00}(t|t) + 2\delta P^{ij}_{01}(t|t) + \tag{75}$$

$$\delta^2 P^{ij}_{02}(t|t) + \delta^3 P^{ij}_{12}(t|t) + \delta^2 P^{ij}_{11}(t|t) + \frac{\delta^4}{4} P^{ij}_{22}(t|t) +$$

$$S^{ij}_{\xi}(t)\delta + S^{ij}_{\mu}(t)\frac{\delta^3}{3} + S^{ij}_{\zeta}(t)\frac{\delta^5}{20} + \sigma^2_{v_{ij}}(t) + S^{ij}_{\beta}h$$

for the case of a time measurement, and $$E[\nu_{ij}(t+\delta)\nu_{ij}(t+\delta)^T] = P^{ij}_{22}(t|t) + 2\delta P^{ij}_{23}(t|t) + \delta^2 P^{ij}_{33}(t|t) + S^{ij}_{\mu}(t)\delta + S^{ij}_{\xi}(t)\frac{\delta^3}{3} + \sigma^2_{vij}(t) \quad (76)$$

for the case of a frequency measurement. It is assumed the oscillator model contains no hidden noise processes. This means that each noise in the model is dominant over some region of the Fourier frequency space. The principal of parsimony encourages this approach to modeling. Inspection of equation 75 leads to the conclusion that each of the parameters dominates the variance of the innovations in a unique region of prediction time interval, $\delta$, making it possible to obtain high quality estimates for each of the parameters through a bootstrapping process. It should be noted that the white phase measurement noise can be separated from the clock noise only by making an independent assessment of the measurement system noise floor.

For each parameter to be estimated, a Kalman filter is computed using a subset of the data chosen to maximize the number of predictions in the interval for which that parameter makes the dominant contribution to the innovations. The filters are designated 0 through 4, starting with zero for the main state estimation filter, which runs as often as possible. Each innovation is used to compute a single-point estimate of the variance of the innovations for the corresponding $\delta$. Substituting the estimated values of the remaining parameters, equation 75 is solved for the dominant parameter, and the estimate of that parameter is updated in an exponential filter of the appropriate length, for example, $$\sigma^2_{vij}(t+\delta) + S^{ij}_{\beta}(t+\delta)h \cong \nu_{ij}(t+\delta)\nu_{ij}(t+\delta)^T - P^{ij}_{00}(t|t) - 2\delta P^{ij}_{01}(t|t) - \delta^2 P^{ij}_{02}(t|t) - \delta^3 P^{ij}_{12}(t|t) - \delta^2 P^{ij}_{11}(t|t) - \frac{\delta^4}{4} P^{ij}_{22}(t|t) - S^{ij}_{\xi}(t)\delta - S^{ij}_{\mu}(t)\frac{\delta^3}{3} - S^{ij}_{\xi}(t)\frac{\delta^5}{20}. \quad (77)$$

If the minimum sampling interval is too long, it may not be possible to estimate one or more of the parameters. However, there is no deleterious consequence of the situation, since a parameter that cannot be estimated is not contributing appreciably to the prediction errors. Simulation testing has shown that the previously described method combines good data efficiency and high accuracy.

Each time a clock pair filter runs, a single estimate is obtained for one of the noise spectral densities or variances of the clock, represented by $F^{ij}$. A Kalman filter can be used to obtain an optimum estimate for all $F^i$, given all possible measurements $F^{ij}$. The $F^i$ for a given noise type are formed into an N dimensional vector $$F(t) = \begin{bmatrix} F^1(t) \\ F^2(t) \\ \cdot \\ \cdot \\ \cdot \\ F^N(t) \end{bmatrix}. \quad (78)$$

The state transition matrix is just the N dimensional identity matrix. The noise vector is chosen to be nonzero in order to allow the estimates to change slowly with time. This does not mean that the clock noises actually experience random walk behavior, only that this is the simplest model that does not permanently lock in fixed values for the noises. The variances of the noises perturbing the clock parameters can be chosen based on the desired time constant of the Kalman filter. Assuming that the noise is small, the Kalman gain is approximately $\sigma_F/\sigma_{meas}$. The parameter value will refresh every M measurements when its variance is set to $1/M^2$ of the variance of the single measurement estimate of the parameter. A reasonable value for the variance of a single measurement is $\sigma^2_{meas}$ being approximately equal to $2F^i$. The measurement matrix for the "ij"th measurement is a $1\times N$ row vector whose "i"th and "j"th elements are unity and whose remaining elements are zero, such that $H^{ij}=[0\ldots010\ldots010\ldots0]$. All the individual clock parameters are updated each cycle of the Kalman recursion, even though the measurement involves only two clocks, because the prior state estimates depend on the separation of variances involving all of the clocks.

The storage requirements for this approach are minimal. There are five N element state vectors, one for each of the possible noise types (white phase noise, white frequency noise, white frequency measurement noise, random walk frequency noise, and random walk frequency noise aging). There are also five $N\times N$ covariance matrixes. A total of $5N(N-1)/2$ cycles of the Kalman recursion are currently believed necessary for the parameter update.

An implementation of the present invention will now be described with respect to FIG. 1. FIG. 1 illustrates a circuit for obtaining a computation of ensemble time from an ensemble of clocks 10. The ensemble 10 includes N clocks 12. The clocks 12 can be any combination of clocks suitable for use with precision time measurement systems. Such clocks may include, but are not limited to cesium clocks, rubidium clocks and hydrogen maser clocks. Additionally, there is no limit on the number of clocks.

Each of the N clocks 12 produces a respective signal $\mu_1, \mu_2, \mu_3, \ldots \mu_N$ which is representative of its respective frequency output. The respective frequency signals are passed through a passive power divider circuit 14 to make them available for use by a time measurement system 16, which obtains the time differences between designated ones of the clocks 12. As discussed above, the desired time differences are the differences between the one of the clocks 12 designated as a hardware reference clock and the remaining clocks 12. The clock 12 which acts as the reference clock can be advantageously changed as desired by an operator. For example, if clock 12 designated "clock 1" is chosen to be the reference clock, the time measurement system 16 determines the differences between the reference clock and the remaining clocks, which are represented by $z_{12}, z_{13}, z_{14}, \ldots z_{1N}$. These data are input to a computer 18 for processing in accordance with the features of the present invention as described above, namely, the complete ensemble definition as provided above. When the ensemble definition as provided by equations 23–25 is provided for in Kalman filters, and since the Kalman filters are software-implemented, the Kalman filters can be stored in memory 20. The computer 18 accesses the memory 20 for the necessary filters as required by the system programming in order to carry out the time scale computation. The weights and other required outside data are input by operator through a terminal 22. Upon completion of the processing of the clock data via the Kalman filters according to the present invention, an estimate of the ensemble time is output from the computer 20 to be manipulated in accordance with the requirements of the user.

As discussed above, Kalman filters have been previously used in connection with ensembles to obtain ensemble time estimates. These Kalman filters embodied the previous incomplete ensemble definitions in Kalman form for the appropriate processing. Accordingly, it will be appreciated by those skilled in the art that the actual implementation of the Kalman equations into a time measurement system as described above and the appropriate programming for the system are procedures known in the art. As also should be appreciated, by providing a complete definition of the ensemble, the present system generally provides a superior calculation of the ensemble time with respect to prior art.

While one embodiment of the invention has been discussed, it will be appreciated by those skilled in the art that various modifications and variations are possible without departing from the spirit and scope of the invention.

What is claimed is:

1. A system for providing an ensemble time comprising:

an ensemble of oscillators, each of said oscillators generating a respective oscillator signal;

first means for determining at least one of a time and frequency difference between oscillator signals for pairs of said oscillators; and second means for providing an ensemble time based on the said at least one of a time and frequency difference and an ensemble time definition, wherein said ensemble time definition includes a time state of a one of said ensemble of oscillators with respect to said ensemble of oscillators that is a first average over said ensemble of oscillators of a time state term and further includes a frequency related state of said one of said ensemble of oscillators with respect to said ensemble of oscillators that is a second average over said ensemble of oscillators of a frequency related state term.

2. A system according to claim 1, wherein:

said ensemble of oscillators comprises N oscillators and said one of said oscillators is designated reference oscillator j, and each of said other N−1 oscillators provides an estimate of time and frequency states of the reference oscillator j with respect to said ensemble of oscillators.

3. The system according to claim 2, wherein:

said first average that provides said time state of said reference oscillator j with respect to said ensemble of oscillators is defined by:

$$u_{je}(t+\delta) = \sum_{i=1}^{N} a_i(t)[u_{ie}(t+\delta|t) + u_{ji}(t+\delta)]$$

where $u_{je}(t+\delta)$ is the time state of the reference oscillator j with respect to the ensemble of oscillators, $a_i(t)$ are the weights given to each oscillator of said ensemble of oscillators for time $u_{ie}(t+\delta|t)$ are the forecasts of the time of each oscillator of said ensemble of oscillators with respect to the ensemble of oscillators at time $(t+\delta)$ based on the true state through time t, and $u_{ji}(t+\delta)$ are times of said reference oscillator j with respect to each of said remaining oscillators of said ensemble of oscillators, and said second average for said frequency related state of said reference oscillator j with respect to said ensemble of oscillators is defined by:

$$y_{je}(t+\delta) = \sum_{i=1}^{N} b_i(t)[y_{ie}(t+\delta|t) + y_{ji}(t+\delta)]$$

where $y_{je}(t+\delta)$ is the frequency related state of the reference clock j with respect to the ensemble of oscillators, $b_i(t)$ are the weights given to each oscillator of said ensemble of oscillators for frequency, $y_{ie}(t+\delta|t)$ are forecasts of the frequency of each oscillator of said ensemble of oscillators with respect to the ensemble of oscillators at time $(t+\delta)$ based on the true states through time t, and $y_{ji}(t+\delta)$ are frequencies of said reference oscillator j with respect to each of said remaining oscillators of said ensemble of oscillators.

4. A system according to claim 3, wherein:

said second means comprises processing means and memory means, the ensemble time definition being embodied by Kalman filters stored in the memory means, the processing means receiving the at least one of a time and frequency difference from said first means and accessing the Kalman filters from the memory means and processing the frequency differences with the Kalman filters to provide the ensemble time.

5. A system according to claim 3, wherein:

the weights $a_i(1)$ and $b_i(t)$ are chosen such that:

$$\sum_{i=1}^{N} a_i(t) = \sum_{i=1}^{N} b_i(t) = 1.$$

6. A system for providing an ensemble time comprising:

an ensemble of oscillators, each of said oscillators generating a respective oscillator signal;

first means for determining frequency differences between oscillator signals for pairs of said oscillators; and second means for providing an ensemble time based on the frequency differences and an ensemble time definition, wherein said ensemble time definition includes a time state of a one of said ensemble of oscillators with respect to said ensemble of oscillators that is a first average over said ensemble of oscillators of a time state term, a frequency state of said one of said ensemble of oscillators with respect to said ensemble of oscillators that is a second average over said ensemble of oscillators of a frequency state term, and a frequency aging state of said one of said ensemble of oscillators with respect to said ensemble of oscillators that is a third average over said ensemble of oscillators of a frequency aging state term.

7. A system according to claim 6, wherein:

said ensemble of oscillators comprises N oscillators and said one of said oscillators is designated as a reference oscillator j, and each of said other N−1 oscillators provides an estimate of time, frequency and frequency aging states of the reference oscillator j with respect to said ensemble of oscillators.

8. A system according to claim 7, wherein:

said first average, said second average, and said third average for said reference oscillator j with respect to the ensemble of oscillators are respectively defined by:

$$u_{je}(t+\delta) \equiv \sum_{i=1}^{N} a_i(t)[u_{ie}(t+\delta|t) + u_{ji}(t+\delta)],$$

where $u_{je}(t+\delta)$ is the time state of the reference oscillator j with respect to the ensemble of oscillators, $a_i(t)$ are the weights given to each oscillator of said ensemble of oscillators for time $u_{ie}(t+\delta|t)$ are the forecasts of the time of each oscillator of said ensemble of oscillators with respect to the ensemble of oscillators at time $(t+\delta)$ based on observations through time t, and $u_{ji}(t+\delta)$ are the times of said reference oscillator j with respect to each of said remaining oscillators of said ensemble of oscillators, $$y_{je}(t+\delta) \equiv \sum_{i=1}^{N} b_i(t)[y_{ie}(t+\delta|t) + y_{ji}(t+\delta)],$$

where $y_{je}(t+\delta)$ is the frequency state of the reference oscillator j with respect to the ensemble of oscillators, $b_i(t)$ are the weights given to each oscillator of said ensemble of oscillators for frequency, $y_{ie}(t+\delta|t)$ are the forecasts of the frequency of each oscillator of said ensemble of oscillators with respect to the ensemble of oscillators at time $(t+\delta)$ based on observations through time t, and $y_{ji}(t+\delta)$ are the frequencies of said reference oscillator j with respect to each of said remaining oscillators of said ensemble of oscillators, and $$w_{je}(t+\delta) \equiv \sum_{i=1}^{N} c_i(t)[w_{ie}(t+\delta|t) + w_{ji}(t+\delta)],$$

where $w_{je}(t+\delta)$ is the frequency aging state of the reference oscillator j with respect to the ensemble of oscillators, $c_i(t)$ are the weights given to each oscillator of said ensemble of oscillators for frequency aging, $w_{ie}(t+\delta|t)$ are the forecasts of the frequency aging of each oscillator of said ensemble of oscillators with respect to the ensemble of oscillators at time $(t+\delta)$ based on observations through time t, and $w_{ji}(t+\delta)$ are the frequency agings of said reference oscillator j with respect to each of said remaining oscillators of said ensemble of oscillators, where:

$$\sum_{i=1}^{N} a_i(t) = \sum_{i=1}^{N} b_i(t) = \sum_{i=1}^{N} c_i(t) = 1.$$

9. A system according to claim 8, wherein:

said second means comprises processing means and memory means, the ensemble time definition being embodied by Kalman filters stored in the memory means, said processing means receiving the frequency differences from said first means and accessing the Kalman filters from the memory means and processing the frequency differences with the Kalman filters to provide the ensemble time.

10. A system according to claim 9, further comprising:

input means for inputting control data to said processing means for changing parameters of the Kalman filters, including the weights for each oscillator of said ensemble of oscillators relating to the time, frequency and the frequency aging of the ensemble time definition.

11. A system as claim in claim 1, wherein:

said frequency related state term includes at least one of the following: a frequency state term and a frequency aging state term.

12. A system for providing an estimate of the ensemble time of an ensemble of clocks, comprising:

an ensemble of clocks, each of said ensemble of clocks providing a clock signal that has a parameter which is capable of being measured with respect to another of said ensemble of clocks;

first means for measuring a difference between said parameter for a pair of said ensemble of clocks, wherein one of said pair of ensemble of clocks is a reference clock; and second means for using said difference and an ensemble time definition to provide an estimate of the ensemble time for said ensemble of clocks, wherein said ensemble time definition includes an average over said ensemble of clocks of a clock state term that includes a forecast clock state vector, wherein said forecast clock state vector is other than an estimated forecast clock state vector.

13. A system, as claimed in claim 12, wherein:

said average includes a first average for a time dimension of said clock state term, wherein said first average for said time dimension is defined by the following:

$$u_{je}(t+\delta) \equiv \sum_{i=1}^{N} a_i(t)[u_{ie}(t+\delta|t) + u_{ji}(t+\delta)]$$

where $u_{je}(t+\delta)$ is the time state of the reference clock of said ensemble of clocks with respect to said ensemble of clocks, $a_i(t)$ are the weights given to each clock of said ensemble of clocks for time, $u_{ie}(t+\delta|t)$ are the forecasts of the time of each clock of said ensemble of clocks with respect to said ensemble of clocks at time $(t+\delta)$ based on the true states through time t, and $u_{ji}(t+\delta)$ are times of said reference clock of said ensemble of clocks with respect to each clock of said ensemble of clocks, wherein said clock state term includes $u_{ie}(t+\delta|t)$ and $u_{ji}(t+\delta)$.

14. A system, as claimed in claim 13, wherein:

said weights $a_i(t)$ are chosen such that:

$$\sum_{i=1}^{N} a_i(t) = 1.$$

15. A system, as claimed in claim 12, wherein:

said average includes a first average for a frequency dimension of said clock state term, wherein said first average for said frequency dimension is defined by the following:

$$y_{je}(t+\delta) \equiv \sum_{i=1}^{N} b_i(t)[y_{ie}(t+\delta|t) + y_{ji}(t+\delta)]$$

where $y_{je}(t+\delta)$ is the frequency state of said reference clock of said ensemble of clocks with respect to said ensemble of clocks, $b_i(t)$ are the weights given to each clock of said ensemble of clocks for frequency, $y_{ie}(t+\delta|t)$ are the forecasts of the frequency of each clock of said ensemble of clocks with respect to said ensemble of clocks at time $(t+\delta)$ based on the true states through time t, and $y_{ji}(t+\delta)$ are the frequencies of said reference clock of said ensemble of clocks with respect to each clock of said ensemble of clocks, wherein said clock state term includes $y_{ie}(t+\delta|t)$ and $y_{ji}(t+\delta)$.

16. A system, as claimed in claim 15, wherein:

said weights $b_i(t)$ are chose such that:

$$\sum_{i=1}^{N} b_i(t) = 1.$$

17. A system, as claimed in claim 12, wherein:

said average includes a first average for a frequency aging dimension of said clock term, wherein said first average for said frequency aging dimension is defined by the following:

$$w_{je}(t+\delta) = \sum_{i=1}^{N} c_i(t)[w_{ie}(t+\delta|t) + w_{ji}(t+\delta)]$$

where $w_{je}(t+\delta)$ is the frequency aging state of said reference clock of said ensemble of clocks with respect to said ensemble of clocks, $c_i(t)$ are the weights given to each clock of said ensemble of clocks for frequency aging, $w_{ie}(t+\delta|t)$ are the forecasts of the frequency aging of each clock of said ensemble of clocks with respect to said ensemble of clocks at time $(t+\delta)$ based on the true states through time t, and $w_{ji}(t+\delta)$ are the frequency agings of said reference clock of said ensemble of clocks with respect to each clock of said ensemble of clocks, wherein said clock state term includes $w_{ie}(t+\delta|t)$ and $w_{ji}(t+\delta)$.

18. A system, as claimed in claim 12, wherein:

said weights and $c_i(t)$ are chosen such that:

$$\sum_{i=1}^{N} c_i(t) = 1.$$

19. A system, as claimed in claim 12, wherein:

said average includes at least two of the following averages: a first average for a time dimension, a second average for a frequency dimension, and a third average for a frequency aging dimension for said clock state term.

20. A system, as claimed in claim 12, wherein:

said average includes at least two of the following averages: a first average for a time dimension, a second average for a frequency dimension, and a third average for a frequency aging dimension for said clock state term, wherein said first average for said time dimension is defined by the following:

$$u_{je}(t+\delta) = \sum_{i=1}^{N} a_i(t)[u_{ie}(t+\delta|t) + u_{ji}(t+\delta)]$$

where $u_{je}(t+\delta)$ is the time state of the reference clock of said ensemble of clocks with respect to said ensemble of clocks, $a_i(t)$ are the weights given to each clock of said ensemble of clocks for time, $u_{ie}(t+\delta|t)$ are the forecasts of the time of each clock of said ensemble of clocks with respect to said ensemble of clocks at time $(t+\delta)$ based on the true states through time t, and $u_{ji}(t+\delta)$ are times of said reference clock of said ensemble of clocks with respect to each clock of said ensemble of clocks, wherein said clock state term includes $u_{ie}(t+\delta|t)$ and $u_{ji}(t+\delta)$, wherein said second average for said frequency dimension is defined by the following:

$$y_{je}(t+\delta) = \sum_{i=1}^{N} b_i(t)[y_{ie}(t+\delta|t) + y_{ji}(t+\delta)]$$

where $y_{je}(t+\delta)$ is the frequency state of said reference clock of said ensemble of clocks with respect to said ensemble of clocks, $b_i(t)$ are the weights given to each clock of said ensemble of clocks for frequency, $y_{ie}(t+\delta|t)$ are the forecasts of the frequency of each clock of said ensemble of clocks with respect to said ensemble of clocks at time $(t+\delta)$ based on the true states through time t, and $y_{ji}(t+\delta)$ are the frequencies of said reference clock of said ensemble of clocks with respect to each clock of said ensemble of clocks, wherein said clock state term for said frequency dimension includes $y_{ie}(t+\delta|t)$ and $y_{ji}(t+\delta)$, wherein said third average for said frequency aging dimension is defined by the following:

$$w_{je}(t+\delta) = \sum_{i=1}^{N} c_i(t)[w_{ie}(t+\delta|t) + w_{ji}(t+\delta)]$$

where $w_{je}(t+\delta)$ is the frequency aging state of said reference clock of said ensemble of clocks with respect to said ensemble of clocks, $c_i(t)$ are the weights given to each clock of said ensemble of clocks for frequency aging, $w_{ie}(t+\delta|t)$ are the forecasts of the frequency aging of each clock of said ensemble of clocks with respect to said ensemble of clocks at time $(t+\delta)$ based on the true states through time t, and $w_{ji}(t+\delta)$ are the frequency agings of said reference clock of said ensemble of clocks with respect to each clock of said ensemble of clocks, wherein said clock state term for said frequency aging dimension includes $w_{ie}(t+\delta|t)$ and $w_{ji}(t+\delta)$.

21. A system, as claimed in claim 20, wherein:

the weights $a_i(t)$ and $b_i(t)$ and $c_i(t)$ of said at least two averages are chosen such that:

$$\sum_{i=1}^{N} a_i(t) = \sum_{i=1}^{N} b_i(t) = \sum_{i=1}^{N} c_i(t) = 1.$$

22. A system, as claimed in claim 12, wherein:

said parameter is at least one of a time and a frequency of a clock of said ensemble of clocks.

23. A system, as claimed in claim 12, wherein:

said first means includes means for selecting a clock of said ensemble of clocks as said reference clock.

24. A system, as claimed in claim 12, wherein:

said average is a weighted average.

25. A system, as claimed in claim 12, wherein:

said average is a weighted average and said second means includes means for selecting a weight to be associated with at least one clock of said ensemble of clocks.

* * * * *

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 4, line 45, following "referred to as", insert -- $\vec{x}_i$. --.

Column 5, equation (1), the left side of the equation, reading "$x_{jk}(t)$", should read -- $\vec{x}_{jk}(t)$ --;

equation (2), reading $$x_{jk}(t+\delta)=\Phi(\delta)x_{jk}(t)+\Gamma s_{jk}(t+\delta|t)+\Phi(\delta)p_{jk}(t) \quad , \quad \textit{should read}$$

$$\vec{x}_{jk}(t+\delta)=\Phi(\delta)\vec{x}_{jk}(t)+\Gamma\vec{s}_{jk}(t+\delta|t)+\Phi(\delta)\vec{p}_{jk}(t) \quad ;$$

equation (4), the left side of the equation, reading "$s_{jk}(t + \delta|t)$", should read -- $\vec{s}_{jk}(t + \delta|t)$ --;

line 62, "$\beta$" should read -- $\beta'$ --;

line 63, "$\epsilon$" should read -- $\epsilon'$ --;

line 64, "$\eta$" should read -- $\eta'$ --;

line 66, "$\alpha$" should read -- $\alpha'$ --.

Column 6, equation (6), that portion of the equation reading "$H=(t)x_{jk}$" should read -- $H(t)\vec{x}_{jk}$ --;

equation (7), that portion of the equation reading "$v_{jk}(t)v_{jk}$" should read -- $\vec{v}_{jk}(t)\vec{v}_{jk}$ --;

equation (10), that portion of the right side reading "$s_{jk}(t+\delta|t)s_{jk}$" should read -- $\vec{s}_{jk}(t+\delta|t)\vec{s}_{jk}$ --;

equation (13), that portion of the left side reading "$(t+\delta)\delta'_{jk}$" should read -- $(t+\delta)\beta'_{jk}$ --.

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 7, equation (14), the right side of the equation, reading $$S_{\epsilon}^{jk}(t)\delta+S_{\mu}^{jk}(t)\delta^3/3+S_{\xi}^{jk}(t)\delta^5/20 \ , \quad \textit{should read}$$

$$S_{\xi}^{jk}(t)\delta+S_{\mu}^{jk}(t)\delta^3/3+S_{\zeta}^{jk}(t)\delta^5/20 \ ;$$

equation (15), that portion of the right side reading "$S_{\xi}^{jk}$" should read -- $S_{\zeta}^{jk}$ --;

equation (16), that portion of the right side reading "$S_{\xi}^{jk}$" should read -- $S_{\zeta}^{jk}$ --;

equation (20), that portion of the right side reading "$S_{\Gamma}^{jk}$" should read -- $S_{\zeta}^{jk}$ --;

equation (21), that portion of the right side reading "$S_{\mu}^{jk}$" should read -- $S_{\zeta}^{jk}$ --;

equation (22), that portion of the right side reading "$S_{\mu}^{jk}$" should read -- $S_{\zeta}^{jk}$ --;

equation (26), reading $$x(t+\delta|t)=\Phi(t+\delta|t)x(t) \ , \quad \textit{should read}$$

$$\vec{x}(t+\delta|t)=\Phi(t+\delta|t)\vec{x}(t) \ .$$

Column 8, equation (28), reading $$x_{je}(t+\delta)=\Phi(\delta)x_{je}(t)+\Gamma s_{je}(t+\delta|t)-\Phi(\delta)p_{je}(t) \ , \quad \textit{should read}$$

$$\vec{x}_{je}(t+\delta)=\Phi(\delta)\vec{x}_{je}(t)+\Gamma\vec{s}_{je}(t+\delta|t)-\Phi(\delta)\vec{p}_{je}(t) \ .$$

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 9, equation (33), the right side of the equation, that portion of the first line which reads "$u_{ke}$ $(t_2|t_1)$" should read -- $\hat{u}_{ke}$ $(t_2|t_1)$ --; that portion of the third line which reads "$y_{ke}$ $(t_2|t_1)$" should read -- $\hat{y}_{ke}$ $(t_2|t_1)$ --;

equation (34), the right side of the equation, that portion of the first line which reads "[$u_{ke}$ $(t_2|t_1)$" should read -- [$\hat{u}_{ke}$ $(t_2|t_1)$ --; that portion of the third line which reads "[$y_{ke}$ $(t_2|t_1)$" should read -- [$\hat{y}_{ke}$ $(t_2|t_1)$ --.

Column 10, line 36, "time t1 is $x(t_1|t_1)-\vec{x}(t_1)$" should read -- time $t_1$ is $\hat{\vec{x}}(t_1|t_1)-\vec{x}(t_1)$ --;

equation (38), the right side of the equation, reading $$E\left\{\left[x(t_1|t_1)-x(t_1)\right]\left[x(t_1|t_1)-x(t_1)\right]^T\right\}, \quad \textit{should read}$$

$$E\left\{\left[\hat{\vec{x}}(t_1|t_1)-\vec{x}(t_1)\right]\left[\hat{\vec{x}}(t_1|t_1)-\vec{x}(t_1)\right]^T\right\};$$

equation (39), the right side of the equation, reading $$E\left\{\left[x(t_2|t_1)-x(t_2)\right]\left[x(t_2|t_1)-x(t_2)\right]^T\right\}, \quad \textit{should read}$$

$$E\left\{\left[\hat{\vec{x}}(t_2|t_1)-\vec{x}(t_2)\right]\left[\hat{\vec{x}}(t_2|t_1)-\vec{x}(t_2)\right]^T\right\};$$

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 10, line 55, following "new", insert -- estimate of --;

equation (41), reading $$x(t_2|t_2) = \Phi(\delta)x(t_1|t_1) + \Phi(\delta)p(t_1) + K(t_2)[z(t_2) - H(t_2)\Phi(\delta)x(t_1|t_1) - H(t_2)\Phi(\delta)p(t_1)] ,$$

*should read*

$$\hat{\vec{x}}(t_2|t_2) = \Phi(\delta)\hat{\vec{x}}(t_1|t_1) + \Phi(\delta)\vec{p}(t_1) + K(t_2)[\vec{z}(t_2) - H(t_2)\Phi(\delta)\hat{\vec{x}}(t_1|t_1) - H(t_2)\Phi(\delta)\vec{p}(t_1)] .$$

Column 12, line 47, the right side of the equation, reading $$\frac{v_{re}^k(t_2)v_{re}^k(t_2)^T}{E\left[v_{re}^k(v_{re})^T\right]} , \quad \textit{should read} \quad \frac{\vec{v}_{re}^k(t_2)\vec{v}_{re}^k(t_2)^T}{E\left[\vec{v}_{re}^k(\vec{v}_{re}^k)^T\right]} ;$$

line 50, "$v^k$" should read -- $\vec{v}^k$ --;

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 12, equation (56), reading $$\nu_{re}^{k}(t_2) = z_{re}^{k}(t_2) - H(t_2)\,\Phi(t_2|t_1)[x(t_1|t_1) + p(t_1)] \ ,$$

*should read*

$$\vec{\nu}_{re}^{k}(t_2) = \vec{z}_{re}^{k}(t_2) - H(t_2)\,\Phi(t_2|t_1)[\hat{\vec{x}}(t_1|t_1) + \vec{p}(t_1)] \ ;$$

equation (57), reading $$\nu_{re}(t_2) = \nu(t_2) - H(t_2)[x(t_2|t_1) - x(t_2)] \ ,$$

*should read*

$$\vec{\nu}_{re}^{k}(t_2) = \vec{\nu}(t_2) - H(t_2)[\hat{\vec{x}}(t_2|t_1) - \vec{x}(t_2)] \ ;$$

equation (58), the left side of the equation, reading $$E\left[\nu_{re}^{k}(\nu_{re}^{k})^{T}\right] \ , \quad \textit{should read} \quad E\left[\vec{\nu}_{re}^{k}(\vec{\nu}_{re}^{k})^{T}\right] \ .$$

UNITED STATES PATENT AND TRADEMARK OFFICE

CERTIFICATE OF CORRECTION

PATENT NO. : 5,155,695
DATED : October 13, 1992
INVENTOR(S) : Stein

It is certified that error appears in the above-identified patent and that said Letters Patent is hereby corrected as shown below:

Column 13, the left side of equation (61), reading $$x_{ri}(t), \quad \textit{should read} \quad \vec{x}_{ri}(t);$$

equation (62), reading $$z_{ri} = Hx_{ri}+v_{ri}, \quad \textit{should read} \quad \vec{z}_{ri} = H\vec{x}_{ri}+\vec{v}_{ri};$$

equation (64), reading $$x_{je}(t_2|t_2) = x_{re}(t_2|t_2) - x_{rj}(t_2|t_2),$$

*should read*

$$\hat{\vec{x}}_{je}(t_2|t_2) = \hat{\vec{x}}_{re}(t_2|t_2) - \hat{\vec{x}}_{rj}(t_2|t_2).$$

Column 15, equation (72), that portion of the equation reading $$\prod_{i=j+1}^{N} \quad \textit{should read} \quad \prod_{i=j+1}^{N}.$$

CERTIFICATE OF CORRECTION

PATENT NO. : 5,155,695
DATED : October 13, 1992
INVENTOR(S) : Stein

It is certified that error appears in the above-identified patent and that said Letters Patent is hereby corrected as shown below:

Column 16, equation (73), reading $$\nu_{ij}(t_2) \equiv z_{ij}(t_2) - H^{ij}(t_2)x_{ij}(t_2|t_1) ,$$

*should read*

$$\vec{\nu}_{ij}(t_2) \equiv \vec{z}_{ij}(t_2) - H^{ij}(t_2)\hat{\vec{x}}_{ij}(t_2|t_1) ;$$

equation (74), the left side of the equation, reading $$E\left[\nu(t_2)\nu(t_2)^T\right] , \quad \textit{should read} \quad E\left[\vec{\nu}(t_2)\vec{\nu}(t_2)^T\right] ;$$

equation (75), the left side of the equation, reading $$E\left[\nu_{ij}(t+\delta)\nu_{ij}(t+\delta)^T\right] , \quad \textit{should read} \quad E\left[\vec{\nu}_{ij}(t+\delta)\vec{\nu}_{ij}(t+\delta)^T\right] .$$

Column 17, equation (76), the left side of the equation, reading $$E\,[\nu_{ij}(t+\delta)\nu_{ij}(t+\delta)^T] , \quad \textit{should read}$$

$$E\,[\vec{\nu}_{ij}(t+\delta)\vec{\nu}_{ij}(t+\delta)^T] ;$$

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 17, equation (77), the first line of the equation, reading $$o^2_{vij}(t+\delta)+S_\beta^{ij}(t+\delta)h = v_{ij}(t+\delta)v_{ij}(t+\delta)^T - ,$$

*should read*

$$\hat{\sigma}^2_{vij}(t+\delta)+\hat{S}_\beta{}'^{ij}(t+\delta)h = \vec{v}_{ij}(t+\delta)\vec{v}_{ij}(t+\delta)^T - ;$$

equation (77), that portion of the third line reading $$- S_\xi^{ij}(t)\delta - S_\mu^{ij}(t)\frac{\delta^3}{3} - S_\zeta^{ij}(t)\frac{\delta^5}{20} ,$$

*should read*

$$- \hat{S}_\xi^{ij}(t)\delta - \hat{S}_\mu^{ij}(t)\frac{\delta^3}{3} - \hat{S}_\zeta^{ij}(t)\frac{\delta^5}{20} ;$$

equation (78), the left side of the equation, reading $F(t)$, *should read* $\vec{F}(t)$.

Column 18, line 13, "$2F^i$" should read -- $2\hat{F}^i$ --.

Column 22, line 37, "state of the reference" should read -- state of said reference --.

UNITED STATES PATENT AND TRADEMARK OFFICE

CERTIFICATE OF CORRECTION

PATENT NO. : 5,155,695

DATED : October 13, 1992

INVENTOR(S) : Stein

It is certified that error appears in the above-identified patent and that said Letters Patent is hereby corrected as shown below:

Column 23, line 38, "claim 12" should read -- claim 17 --.

Column 24, line 5, following "term", insert -- for said time dimension --.

Signed and Sealed this

Fourth Day of January, 1994

Bruce Lehman

*Attest:*

BRUCE LEHMAN

*Attesting Officer*

*Commissioner of Patents and Trademarks*